US008958511B2

(12) United States Patent
Joo et al.

(10) Patent No.: US 8,958,511 B2
(45) Date of Patent: Feb. 17, 2015

(54) SYSTEM AND METHOD FOR DETECTING BROADBAND GLOBAL POSITIONING SYSTEM (GPS) JAMMING

(71) Applicant: Electronics and Telecommunications Research Institute, Daejeon (KR)

(72) Inventors: In One Joo, Daejeon (KR); Jeom Hun Lee, Daejeon (KR); Cheon Sig Sin, Daejeon (KR); Sang Uk Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 14/024,211

(22) Filed: Sep. 11, 2013

(65) Prior Publication Data

US 2014/0086374 A1 Mar. 27, 2014

(30) Foreign Application Priority Data

Sep. 27, 2012 (KR) ..... 10-2012-0107840
Mar. 27, 2013 (KR) ..... 10-2013-0032488

(51) Int. Cl.
*H04K 3/00* (2006.01)

(52) U.S. Cl.
CPC ..... *H04K 3/228* (2013.01)
USPC ..... 375/350

(58) Field of Classification Search
CPC ..... H04K 3/228
USPC ..... 375/350
See application file for complete search history.

(56) References Cited

U.S. PATENT DOCUMENTS

| | | | | |
|---|---|---|---|---|
| 4,546,356 | A * | 10/1985 | Petitjean et al. | 342/16 |
| 6,239,743 | B1 * | 5/2001 | Lennen | 342/357.63 |
| 6,704,557 | B1 * | 3/2004 | Krishnamurthy et al. | 455/278.1 |
| 2005/0242990 | A1 * | 11/2005 | Lawrence et al. | 342/357.12 |
| 2006/0222058 | A1 * | 10/2006 | Simic et al. | 375/150 |
| 2006/0234641 | A1 | 10/2006 | LaGrotta | |
| 2006/0291540 | A1 * | 12/2006 | Lee | 375/147 |
| 2007/0291825 | A1 * | 12/2007 | Endoh et al. | 375/147 |

FOREIGN PATENT DOCUMENTS

KR 10-1169766 B1 7/2012

* cited by examiner

*Primary Examiner* — Juan A Torres

(57) ABSTRACT

A system and method for detecting broadband global positioning system (GPS) jamming is provided, the system including a local oscillator maintainer to maintain a plurality of local oscillators, a frequency band selector to select a frequency band in which jamming is to be detected, in response to receipt of a radio frequency (RF) signal, an oscillating signal output unit to allow an oscillating signal to be output from a local oscillator identified based on the selected frequency band, among the plurality of local oscillators, and an intermediate frequency (IF) signal generator to generate an IF signal using the RF signal and the oscillating signal.

17 Claims, 5 Drawing Sheets

SYSTEM AND METHOD FOR DETECTING BROADBAND GLOBAL POSITIONING SYSTEM (GPS) JAMMING

CROSS-REFERENCE TO RELATED APPLICATIONS

This application claims the benefit of Korean Patent Application No. 10-2012-0107840, filed on Sep. 27, 2012, and Korean Patent Application No. 10-2013-0032488, filed on Mar. 27, 2013, in the Korean Intellectual Property Office, the disclosures of which are incorporated herein by reference.

BACKGROUND

1. Field of the Invention

The present invention relates to technology for selecting a frequency band in response to receipt of a radio frequency (RF) signal from a global positioning system (GPS), identifying a local oscillator corresponding to the selected frequency band, among a plurality of local oscillators, and generating an intermediate frequency to be used for detecting jamming.

2. Description of the Related Art

A global positioning system (GPS) signal may use a radio frequency (RF) signal of an L1 frequency band, an L2 frequency band, and an L5 frequency band. Jamming which disrupts a flow of the GPS signal may occur when an input frequency of the RF signal is converted into an intermediate frequency (IF). In a conventional method, such conversion into the IF may be performed individually for each RF signal through a converter.

However, when the converter is used individually for each RF signal, a system complexity may increase. Accordingly, the RF signal may be vulnerable to a change of a frequency band.

Accordingly, there is a demand for technology to reduce duplicate processing, by sharing a single apparatus for generating an IF signal, irrespective of a type of an RF signal, using a time division method.

SUMMARY

An aspect of the present invention provides a system and method that may integrate duplicate processing processes for each frequency band in converting an input frequency of a radio frequency (RF) signal of a plurality of frequency bands into an intermediate frequency (IF).

Another aspect of the present invention also provides a system and method that may manage local oscillators corresponding to a number of frequency bands, and identify a local oscillator corresponding to a selected RF signal.

According to an aspect of the present invention, there is provided a system for detecting global positioning system (GPS) jamming, the system including a local oscillator maintainer to maintain a plurality of local oscillators, a frequency band selector to select a frequency band in which jamming is to be detected, in response to receipt of an RF signal, an oscillating signal output unit to allow an oscillating signal to be output from a local oscillator identified based on the selected frequency band, among the plurality of local oscillators, and an IF signal generator to generate an IF signal using the RF signal and the oscillating signal.

According to another aspect of the present invention, there is also provided a method of detecting GPS jamming, the method including maintaining a plurality of local oscillators, selecting a frequency band in which jamming is to be detected, in response to receipt of an RF signal, allowing an oscillating signal to be output from a local oscillator identified by the selected frequency band, among the plurality of local oscillators, and generating an IF signal using the RF signal and the oscillating signal.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
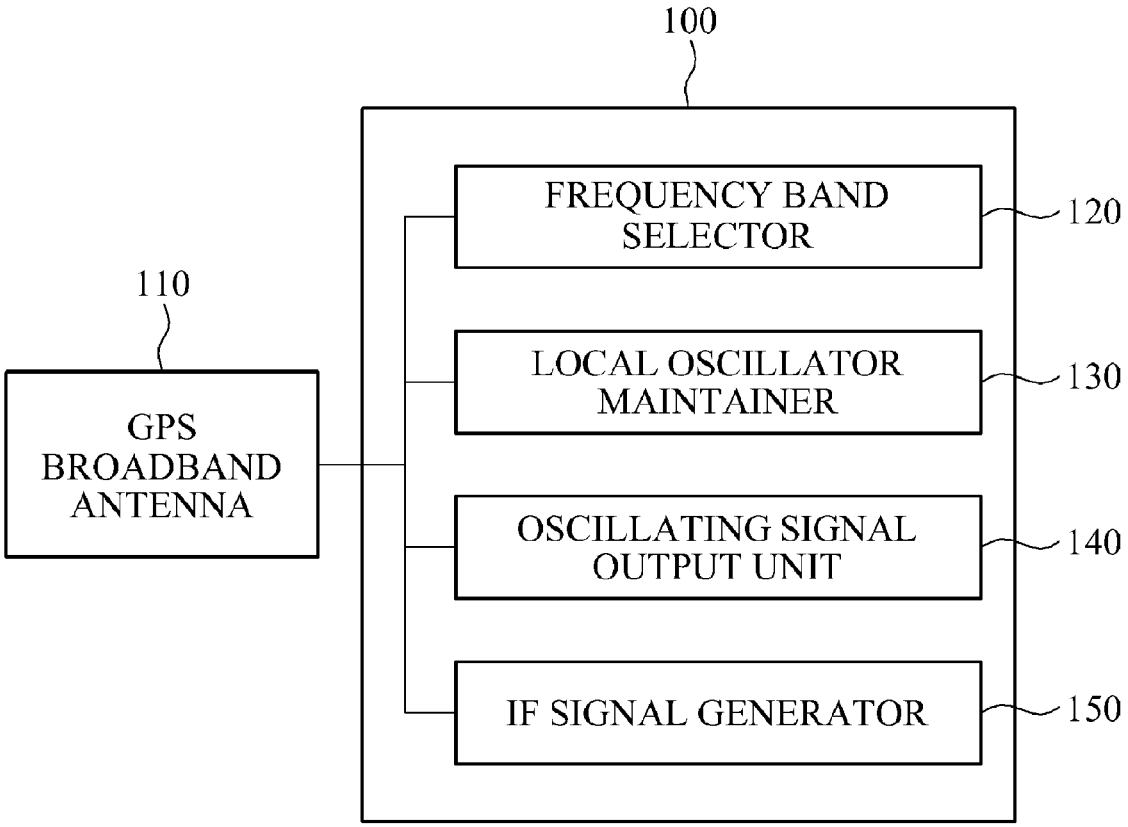
FIG. 1 is a block diagram illustrating a configuration of a system for detecting global positioning system (GPS) jamming according to an embodiment of the present invention.

Reference will now be made in detail to a system and method for detecting global positioning system (GPS) jamming according to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a block diagram illustrating a configuration of a system 100 for detecting GPS jamming according to an embodiment of the present invention. Hereinafter, the system 100 for detecting GPS jamming will be referred to as the "system".

Referring to FIG. 1, a GPS broadband antenna 110 may sense a radio frequency (RF) signal in the air, and transfer the RF signal to the system 100. The RF signal refers to a signal of a high frequency band that may transfer information on a location of a GPS satellite in a wireless manner. The RF signal may be divided into an L1 frequency band, an L2 frequency band, and an L5 frequency band. The GPS broadband antenna 110 may sense the RF signal and convert the RF signal into an electrical signal on an internal conducting wire.

The system 100 may maintain a local oscillator based on a type of the RF signal, convert the RF signal into an intermediate frequency (IF) signal, and detect jamming. Here, jamming refers to an error, or noise that disrupts communication of the RF signal.

The system 100 may include a frequency band selector 120, a location oscillator maintainer 130, an oscillating signal output unit 140, and an IF signal generator 150, in order to detect jamming.

The frequency band selector 120 may select a frequency band in which jamming is to be detected, in the RF signal. The frequency band selector 120 may confirm a frequency band with respect to the RF signal, and select the confirmed frequency band as the frequency band in which jamming is to be detected.

The local oscillator maintainer 130 may maintain a plurality of local oscillators. A local oscillator may supply an oscillating signal that may convert the frequency band of the RF signal. A number of the local oscillators may be identical to a number of selected frequency bands.

The local oscillator maintainer 130 may set regular and independent periods with respect to the local oscillators, and identify a local oscillator as a set period begins. The local oscillator maintainer 130 may set the periods to begin in succession. For example, when the RF signal is divided into three frequency bands, the local oscillator maintainer 130 may set each of the periods of the local oscillators to 1 second, and set a period of a second local oscillator to begin when a period of a first local oscillator ends.

The local oscillator maintainer 130 may set the periods with respect to the local oscillators not to overlap, based on priority, and set lengths of the periods to differ from each other based on an external command. The RF signal may have a different probability of jamming being detected, for each frequency band. The local oscillator maintainer 130 may set a relatively long period for a local oscillator of a frequency band in which a probability of jamming being detected is relatively high.

The oscillating signal output unit 140 may allow an oscillating signal to be output from a local oscillator identified based on the selected frequency band, among the plurality of local oscillators. The oscillating signal output unit 140 may allow an output from the local oscillator of the selected frequency band when the period begins, thereby supplying oscillating signals corresponding to frequency bands of the RF signal, uniformly.

The IF signal generator 150 may generate an IF signal using the RF signal and the oscillating signal. The IF signal generator 150 may generate the IF signal by mixing the RF signal with the oscillating signal. In this example, the IF signal generator 150 may use a mixer configured to convert a frequency band. The mixer may mix a frequency band of the RF signal with a frequency band of the oscillating signal, and calculate a frequency band corresponding to a sum or a difference thereof.

The IF signal generator 150 may pass the IF signal through a bandwidth filter to eliminate a signal of an unselected frequency band from the IF signal. When the RF signal is mixed with the oscillating signal by the mixer, noise may be included. The IF signal generator 150 may input the IF signal into the bandwidth filter to attenuate frequency bands excluding the selected frequency band. The IF signal generator 150 may configure the bandwidth filter, by combining circuits having a characteristic of passing relatively high frequency bands and having a characteristic of passing relatively low frequency bands.

The IF signal generator 150 may convert the IF signal into digital sample data. The IF signal generator 150 may extract a value of a portion of the IF signal corresponding to an analog signal, and convert the extracted value into the digital sample data. The digital sample data may transmit GPS information.

The IF signal generator 150 may generate a spectrum, by classifying components of the digital sample data based on a size of a wavelength. The system 100 may detect jamming through the spectrum.

Figure 2:
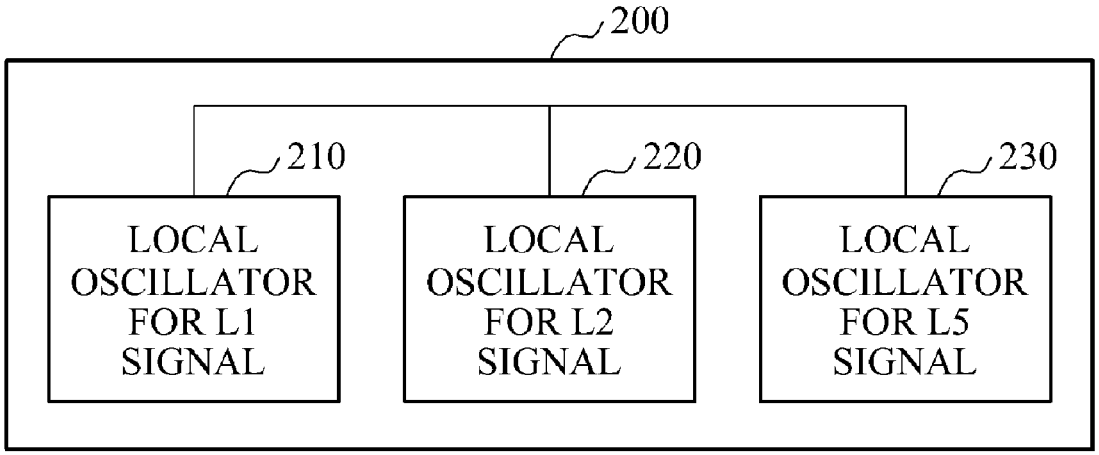
FIG. 2 is a block diagram illustrating a local oscillator maintainer according to an embodiment of the present invention.

FIG. 2 is a block diagram illustrating a local oscillator maintainer 200 according to an embodiment of the present invention.

Referring to FIG. 2, the local oscillator maintainer 200 may confirm an L1 frequency band, an L2 frequency band, and an L5 frequency band with respect to an RF signal, and maintain three local oscillators, in response to receipt of the RF signal.

The local oscillators may include a local oscillator 210 for an L1 signal, a local oscillator 220 for an L2 signal, and a local oscillator 230 for an L5 signal.

The local oscillator 210 for the L1 signal may supply an oscillating signal to the RF signal of an L1 frequency band. The L1 frequency band may correspond to 1.57542 gigahertz (GHz). The L1 frequency band may transfer information to be used for measuring a distance from a GPS satellite.

The local oscillator 220 for the L2 signal may supply an oscillating signal to the RF signal of an L2 frequency band. The L2 frequency band may correspond to 1.2276 GHz.

The local oscillator 230 for the L5 signal may supply an oscillating signal to the RF signal of an L5 frequency band. The L5 frequency band may correspond to 1.1764 GHz. The L5 frequency band may be less affected by a peripheral frequency band, thereby providing accurate and stable geographic information The local oscillator maintainer 200 may set periods with respect to the local oscillator 210 for the L1 signal, the local oscillator 220 for the L2 signal, and the local oscillator 230 for the L5 signal. The local oscillator maintainer 200 may set each period to 1 second, and set the periods of the local oscillator 210 for the L1 signal, the local oscillator 220 for the L2 signal, and the local oscillator 230 for the L5 signal to begin in succession.

The local oscillator maintainer 200 may set the periods not to overlap, based on priority. The local oscillator maintainer 200 may assign a highest priority to the local oscillator 210 for the L1 signal of which a frequency band is relatively high. Based on the priority, the period of the local oscillator 230 for the L5 signal of which a frequency band is lowest may end last. The period of the local oscillator 210 of the L1 signal may be repeated.

The local oscillator maintainer 200 may set lengths of the periods to differ from each other, based on an external command. The local oscillator maintainer 200 may set a relatively long period for a local oscillator of a frequency band in which a probability of jamming being detected is highest.

The local oscillator maintainer 200 may identify one of the local oscillator 210 for the L1 signal, the local oscillator 220 for the L2 signal, and the local oscillator 230 for the L5 signal, when a set period begins.

Figure 3:
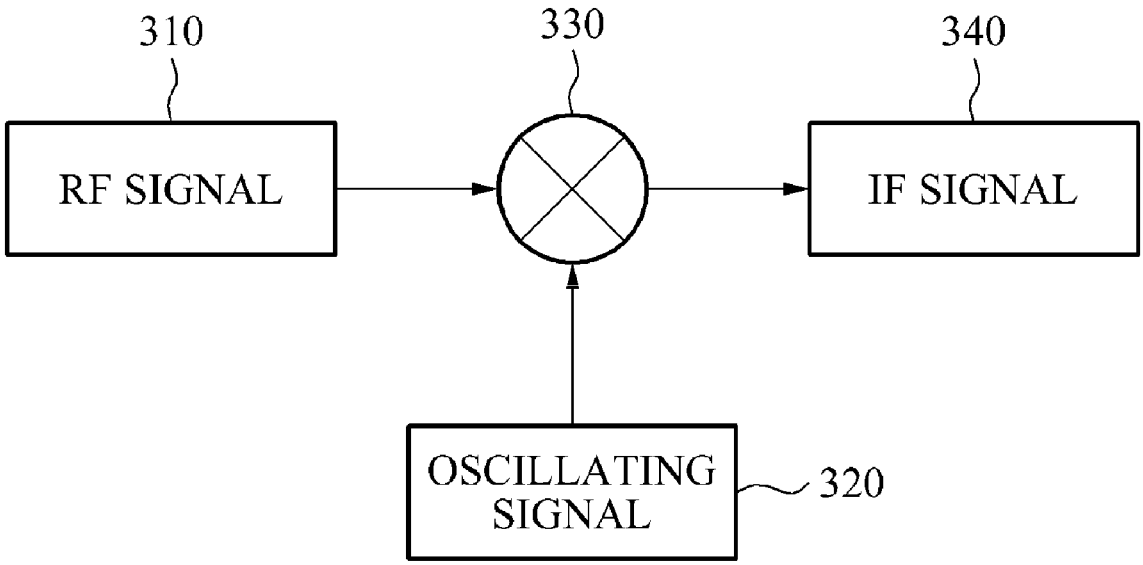
FIG. 3 is a diagram illustrating generation of an intermediate frequency (IF) signal according to an embodiment of the present invention.

FIG. 3 is a diagram illustrating generation of an IF signal according to an embodiment of the present invention.

Referring to FIG. 3, a system for detecting GPS jamming, hereinafter referred to as the "system", may receive an RF signal 310.

The RF signal 310 may be propagated by a GPS satellite. The RF signal 310 may be assigned a relatively high frequency band not overlapping frequency bands of other wireless communication systems.

The system may maintain a local oscillator corresponding to the RF signal 310. The local oscillator may correspond to a circuit generating an oscillating signal 320 through an amplification and feedback phenomenon.

The system may set a period with respect to the local oscillator, and allow the oscillating signal 320 to be output from the local oscillator when the set period begins.

The oscillating signal 320 may correspond to a frequency band identical to a value obtained by subtracting a frequency band of an IF signal 340 from a frequency band of the RF signal 310. The oscillating signal 320 may correspond to a frequency band lower than the frequency band of the RF signal 310, and may down-convert the RF signal 310.

The system may generate the IF signal 340 by mixing the RF signal 310 with the oscillating signal 320 using a mixer 330. The mixer 330 may include a circuit configured to convert a high frequency band into a low frequency band and a low frequency band into a high frequency band. The mixer 330 may calculate a frequency band corresponding to a difference between the frequency band of the RF signal 310 and the frequency band of the oscillating signal 320 to generate the IF signal 340. The system may maintain information expressed in the RF signal 310, and decrease the frequency band, thereby detecting both the information and jamming.

The RF signal 310 may be converted into the IF signal 340, and then into digital sample data. The digital sample data may be assigned a low frequency band to express GPS information. The system may convert the RF signal 310 into the digital sample data, and generate the IF signal 340 before jamming is detected, thereby absorbing noise resulting from mixing by the mixer 330. In addition, the system may detect jamming stably, by isolating the digital sample data and the RF signal 310 through the IF signal 340.

Figure 4:
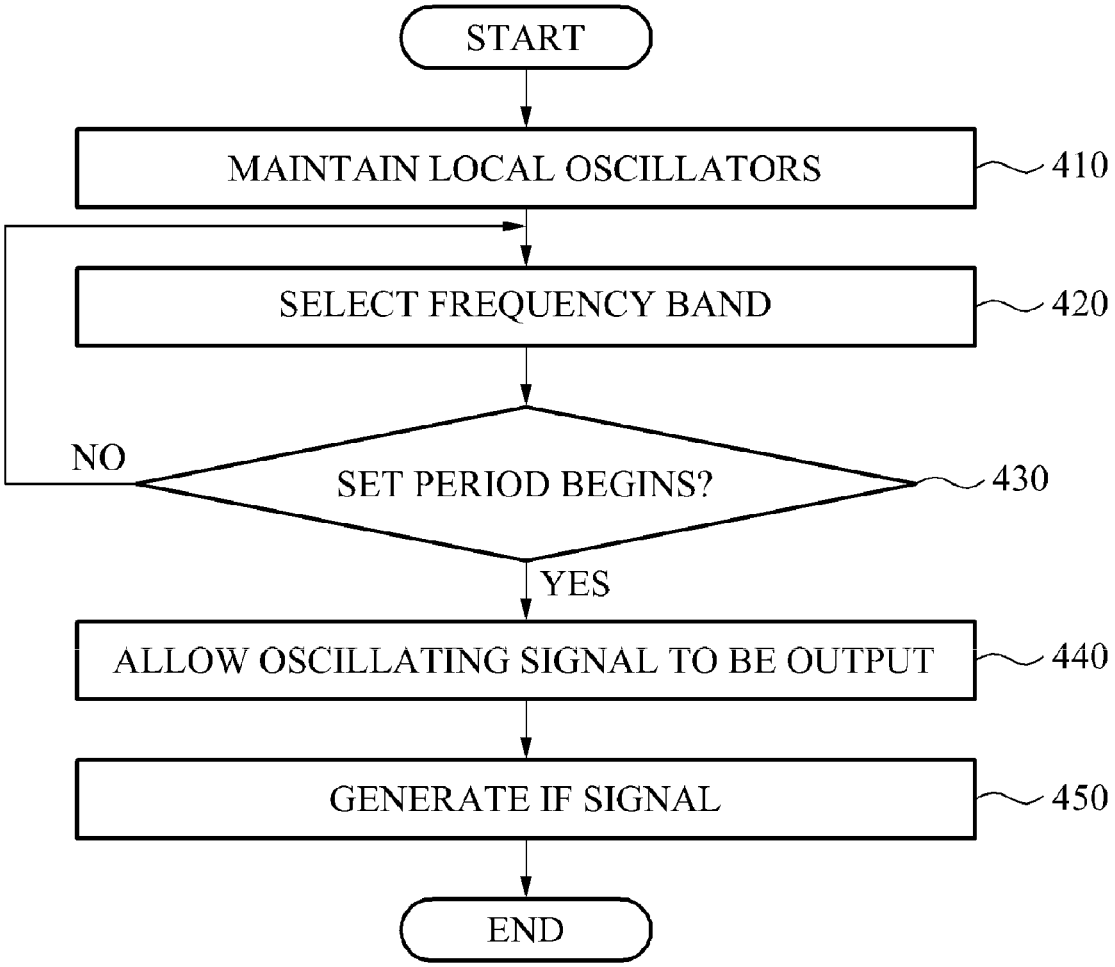
FIG. 4 is a flowchart illustrating a method of detecting GPS jamming according to an embodiment of the present invention.

FIG. 4 is a flowchart illustrating a method of detecting GPS jamming according to an embodiment of the present invention. The method of FIG. 4 may be performed by a system for detecting GPS jamming.

Referring to FIG. 4, in operation 420, a frequency band in which jamming is to be detected may be selected in response to receipt of an RF signal. A frequency band with respect to the RF signal may be confirmed, and the confirmed frequency band may be selected as the frequency band in which jamming is to be detected.

In operation 410, a plurality of local oscillators to supply oscillating signals to the RF signal may be maintained. In operation 430, periods with respect to the local oscillators may be set, and whether a period begins may be verified. The periods may be set to begin in succession. The periods with respect to the local oscillators may be set not to overlap, based on priority. In addition, lengths of the periods with respect to the local oscillators may be set to differ from each other, based on an external command.

When a set period begins, an oscillating signal may be allowed to be output from a local oscillator, in operation 440. By allowing an output from a single local oscillator for each period, oscillating signals corresponding to frequency bands of the RF signal may be supplied uniformly.

In operation 450, an IF signal may be generated using the oscillating signal. By mixing a frequency band of the RF signal with a frequency band of the oscillating signal, a frequency band corresponding to a sum or a difference thereof may be calculated. By converting the frequency band, the IF signal in which original information included in the RF signal is expressed may be generated.

The IF signal may be passed through a bandwidth filter to eliminate a signal of an unselected frequency band from the IF signal. The IF signal may be input into the bandwidth filter to pass the frequency band of the RF signal and attenuate remaining frequency bands.

When the IF signal is filtered, the IF signal may be converted into digital sample data. A value of a portion of the IF signal corresponding to an analog signal may be extracted, and the extracted value may be converted into the digital sample data. A spectrum may be generated from the digital sample data to detect jamming.

Figure 5:
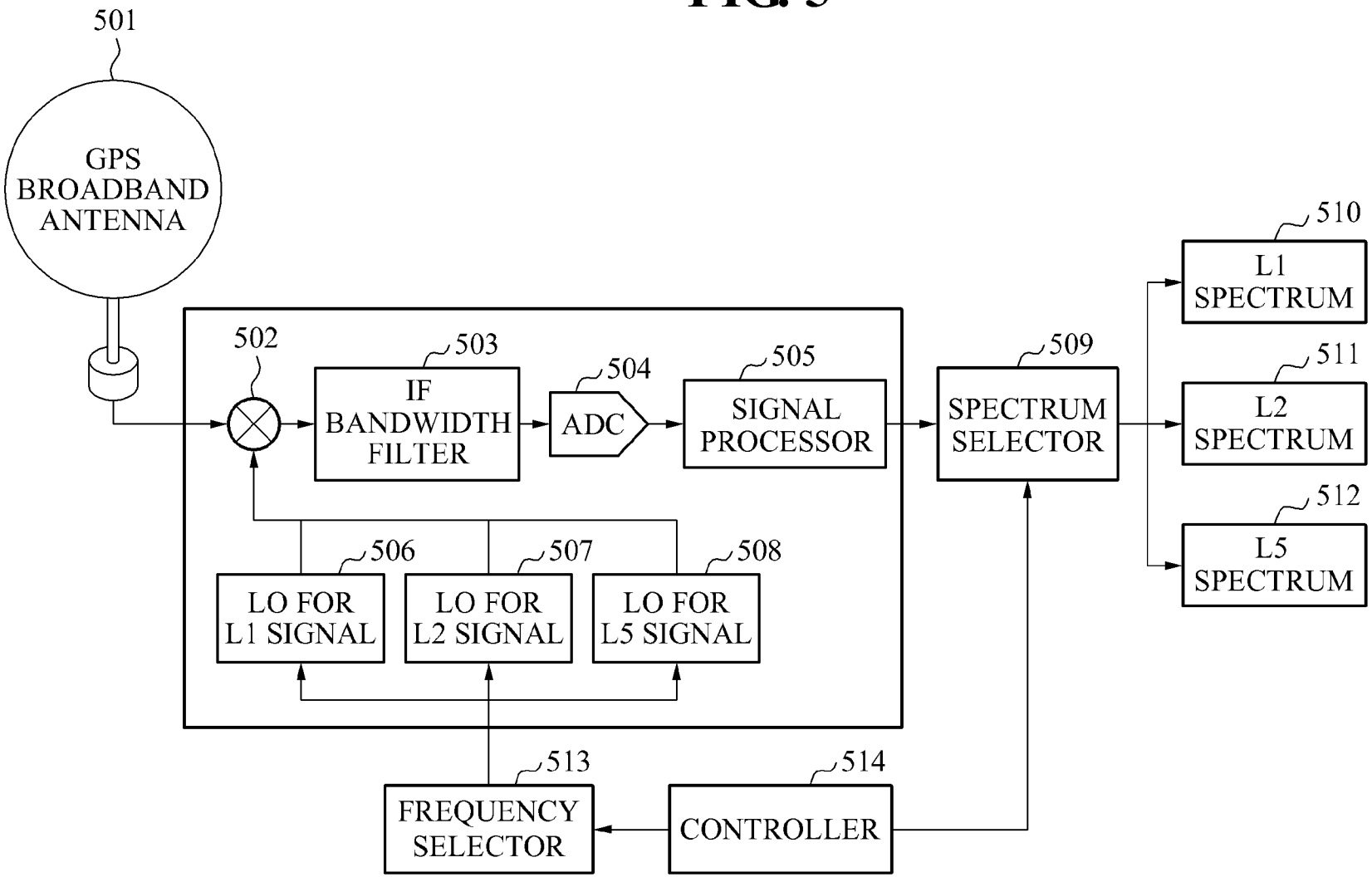
FIG. 5 is a diagram illustrating a configuration of a system for detecting GPS jamming according to another embodiment of the present invention.

FIG. 5 is a diagram illustrating a configuration of a system for detecting GPS jamming according to another embodiment of the present invention.

Referring to FIG. 5, the system for detecting GPS jamming, hereinafter referred to as the "system", may include a GPS broadband antenna 501, a mixer 502, an IF bandwidth filter 503, an analog-to-digital converter (ADC) 504, a signal processor 505, a local oscillator 506 for an L1 signal, a local oscillator 507 for an L2 signal, and a local oscillator 508 for an L5 signal. The system may further include a spectrum selector 509, a frequency selector 513, and a controller 514.

The GPS broadband antenna 501 may receive an RF signal of L1, L2 and L5 GPS frequency bands.

The controller 514 may transmit a frequency band in which jamming is to be detected, among the L1, L2, and L5 GPS frequency bands, to the frequency selector 513 and the spectrum selector 509.

The frequency selector 513 may provide, to the mixer 502, a local oscillator corresponding to the transmitted frequency band, among the local oscillator 506 for the L1 signal, the local oscillator 507 for the L2 signal, and the local oscillator 508 for the L5 signal.

The mixer 502 may mix the RF signal of the selected frequency band with the local oscillator, and down-convert the RF signal into an IF signal. In this example, the IF signal may include all IF signals of the L1, L2, and L5 GPS frequency bands.

The IF bandwidth filter 503 may filter the IR signal to eliminate an IF signal not corresponding to the selected frequency band, among the L1, L2, and L5 GPS frequency bands.

The ADC 504 may convert the IF signal into digital sample data.

The signal processor 505 may calculate spectrum results from the digital sample data.

The spectrum selector 509 may determine a spectrum corresponding to the spectrum results, among an L1 spectrum 510, an L2 spectrum 511, and an L5 spectrum 512. As a result, the system may detect jamming through the spectrum results.

The above-described exemplary embodiments of the present invention may be recorded in computer-readable media including program instructions to implement various operations embodied by a computer. The media may also include, alone or in combination with the program instructions, data files, data structures, and the like. Examples of computer-readable media include magnetic media such as hard disks, floppy disks, and magnetic tape; optical media such as CD ROM discs and DVDs; magneto-optical media such as floptical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described exemplary embodiments of the present invention, or vice versa.

According to exemplary embodiments of the present invention, an efficiency may increase by implementing, using a single apparatus, a process of detecting jamming identically in an RF signal from a GPS based on a frequency band.

According to exemplary embodiment of the present invention, a plurality of local oscillators corresponding to an RF signal may be managed, and an IF signal may be generated from the RF signal.

Although a few exemplary embodiments of the present invention have been shown and described, the present invention is not limited to the described exemplary embodiments.

Instead, it would be appreciated by those skilled in the art that changes may be made to these exemplary embodiments without departing from the principles and spirit of the invention, the scope of which is defined by the claims and their equivalents.

What is claimed is:

1. A system for detecting global positioning system (GPS) jamming, the system comprising:

a local oscillator maintainer to maintain a plurality of local oscillators;

a frequency band selector to select a frequency band in which jamming is to be detected, in response to receipt of a radio frequency (RF) signal;

an oscillating signal output unit to allow an oscillating signal to be output from a local oscillator, which is identified based on the selected frequency band, among the plurality of local oscillators; and an intermediate frequency (IF) signal generator to generate an IF signal using the RF signal and the oscillating signal, wherein the local oscillator maintainer sets lengths of periods with respect to the plurality of local oscillators to differ from each other, based on an external command.

2. The system of claim 1, wherein the IF signal generator passes the IF signal through a bandwidth filter to eliminate a signal of an unselected frequency band from the IF signal.

3. The system of claim 1, wherein the frequency band selector confirms a frequency band with respect to the RF signal received at an antenna, and selects the confirmed frequency band as the frequency band in which jamming is to be detected.

4. The system of claim 1, wherein when a period begins, the oscillating signal output unit allows an oscillating signal to be output from a local oscillator identified by the period.

5. The system of claim 1, wherein the IF signal generator mixes the RF signal with the oscillating signal.

6. The system of claim 1, wherein the IF signal generator converts the IF signal into digital sample data.

7. The system of claim 4, wherein the local oscillator maintainer sets the periods with respect to the plurality of local oscillators not to overlap.

8. The system of claim 4, wherein the local oscillator maintainer sets the periods with respect to the plurality of local oscillators, based on priority.

9. The system of claim 6, wherein the IF signal generator generates a spectrum from the digital sample data.

10. A method of detecting global positioning system (GPS) jamming, the method comprising:

maintaining a plurality of local oscillators;

selecting a frequency band in which jamming is to be detected, in response to receipt of a radio frequency (RF) signal;

setting periods with respect to the plurality of local oscillators;

allowing an oscillating signal to be output from a local oscillator, which is identified based on the selected frequency band and a set period when the period begins, among the plurality of local oscillators; and generating an intermediate frequency (IF) signal using the RF signal and the oscillating signal, wherein the setting comprises setting lengths of the periods with respect to the plurality of local oscillators to differ from each other, based on an external command.

11. The method of claim 10, further comprising:

passing the IF signal through a bandwidth filter to eliminate a signal of an unselected frequency band from the IF signal.

12. The method of claim 10, wherein the selecting comprises:

confirming a frequency band with respect to the RF signal received at an antenna; and selecting the confirmed frequency band as the frequency band in which jamming is to be detected.

13. The method of claim 10, wherein the setting comprises setting the periods with respect to the plurality of local oscillators not to overlap.

14. The method of claim 10, wherein the setting comprises setting the periods with respect to the plurality of local oscillators, based on priority.

15. The method of claim 10, wherein the generating comprises mixing the RF signal with the oscillating signal.

16. The method of claim 10, further comprising:

converting the IF signal into digital sample data.

17. The method of claim 16, further comprising generating a spectrum from the digital sample data.

* * * * *